US006588079B1

(12) United States Patent
Manzano

(10) Patent No.: US 6,588,079 B1
(45) Date of Patent: Jul. 8, 2003

(54) SHOELACE FASTENING ASSEMBLY

(76) Inventor: Daniel Manzano, 81-01 133rd Ave., Ozone Park, NY (US) 11417

( * ) Notice: Subject to any disclaimer, the term of this patent is extended or adjusted under 35 U.S.C. 154(b) by 0 days.

(21) Appl. No.: 10/104,915

(22) Filed: Mar. 25, 2002

(51) Int. Cl.[7] ..... A43C 7/00
(52) U.S. Cl. ..... 24/712.5; 24/713
(58) Field of Search ..... 36/50.1, 50.5; 24/712, 712.1, 712.4, 712.5, 713

(56) References Cited

U.S. PATENT DOCUMENTS 1,385,238 A * 7/1921 Anthon ..... 36/50.1
2,266,083 A * 12/1941 Rzepa ..... 24/712.4
2,673,381 A * 3/1954 Dueker ..... 24/712
2,994,935 A * 8/1961 Buchholz ..... 24/68 SK
4,094,029 A * 6/1978 Carlile ..... 12/113
5,226,246 A * 7/1993 Soo ..... 36/50.1
5,259,094 A * 11/1993 Zepeda ..... 24/712
5,692,276 A * 12/1997 Paxton ..... 24/713.6
5,839,210 A * 11/1998 Bernier et al. ..... 36/50.1
2002/0100188 A1 * 8/2002 Jacques et al. ..... 36/50.1

FOREIGN PATENT DOCUMENTS

EP 330378 A2 * 8/1989 ..... A43C/11/06

* cited by examiner

*Primary Examiner*—James R. Brittain

(57) ABSTRACT

A shoelace fastening assembly for making it easier for the user to secure the laces and also to prevent the laces from becoming undone. The shoelace fastening assembly includes a pair of fastener assemblies each of which includes an elongate housing member being adapted to be securely attached along an edge of an instep portion of a footwear, and also includes a rail member being slidably disposed in the elongate housing member; and also includes a plurality of shoelaces each having a definite length and being adjustably and fastenably disposed in and through the elongate housing members; and further includes a plurality of stop members being spacedly disposed about and along lengths of the plurality of shoelaces for locking the shoelaces in the elongate housing members.

9 Claims, 3 Drawing Sheets

SHOELACE FASTENING ASSEMBLY

BACKGROUND OF THE INVENTION

1. Field of the Invention

The present invention relates to shoelace fasteners and more particularly pertains to a new shoelace fastening assembly for making it easier for the user to secure the laces and also to prevent the laces from becoming undone.

2. Description of the Prior Art

The use of shoelace fasteners is known in the prior art. More specifically, shoelace fasteners heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,295,315; 6,049,955; 6,163,941; 4,796,337; 5,852,852; 6,175,994; 4,646,401; and U.S. Pat. No. Des. 405,602.

While these devices fulfill their respective, particular objectives and requirements, the aforementioned patents do not disclose a new shoelace fastening assembly. The prior art includes inventions having ratchet and pawl mechanisms for securing the shoelaces.

SUMMARY OF THE INVENTION

The general purpose of the present invention, which will be described subsequently in greater detail, is to provide a new shoelace fastening assembly which has many of the advantages of the shoelace fasteners mentioned heretofore and many novel features that result in a new shoelace fastening assembly which is not anticipated, rendered obvious, suggested, or even implied by any of the prior art shoelace fasteners, either alone or in any combination thereof. The present invention includes a pair of fastener assemblies each of which includes an elongate housing member being adapted to be securely attached along an edge of an instep portion of a footwear, and also includes a rail member being slidably disposed in the elongate housing member; and also includes a plurality of shoelaces each having a definite length and being adjustably and fastenably disposed in and through the elongate housing members; and further includes a plurality of stop members being spacedly disposed about and along lengths of the plurality of shoelaces for locking the shoelaces in the elongate housing members. None of the prior art describes rail member and shoelaces having stop members for tightly fastening the shoelaces.

There has thus been outlined, rather broadly, the more important features of the shoelace fastening assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new shoelace fastening assembly which has many of the advantages of the shoelace fasteners mentioned heretofore and many novel features that result in a new shoelace fastening assembly which is not anticipated, rendered obvious, suggested, or even implied by any of the prior art shoelace fasteners, either alone or in any combination thereof.

Still another object of the present invention is to provide a new shoelace fastening assembly for making it easier for the user to secure the laces and also to prevent the laces from becoming undone.

Still yet another object of the present invention is to provide a new shoelace fastening assembly that is easy and convenient to use.

Even still another object of the present invention is to provide a new shoelace fastening assembly that eliminates a user from having to lace up the shoes and then tighten and tie the laces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
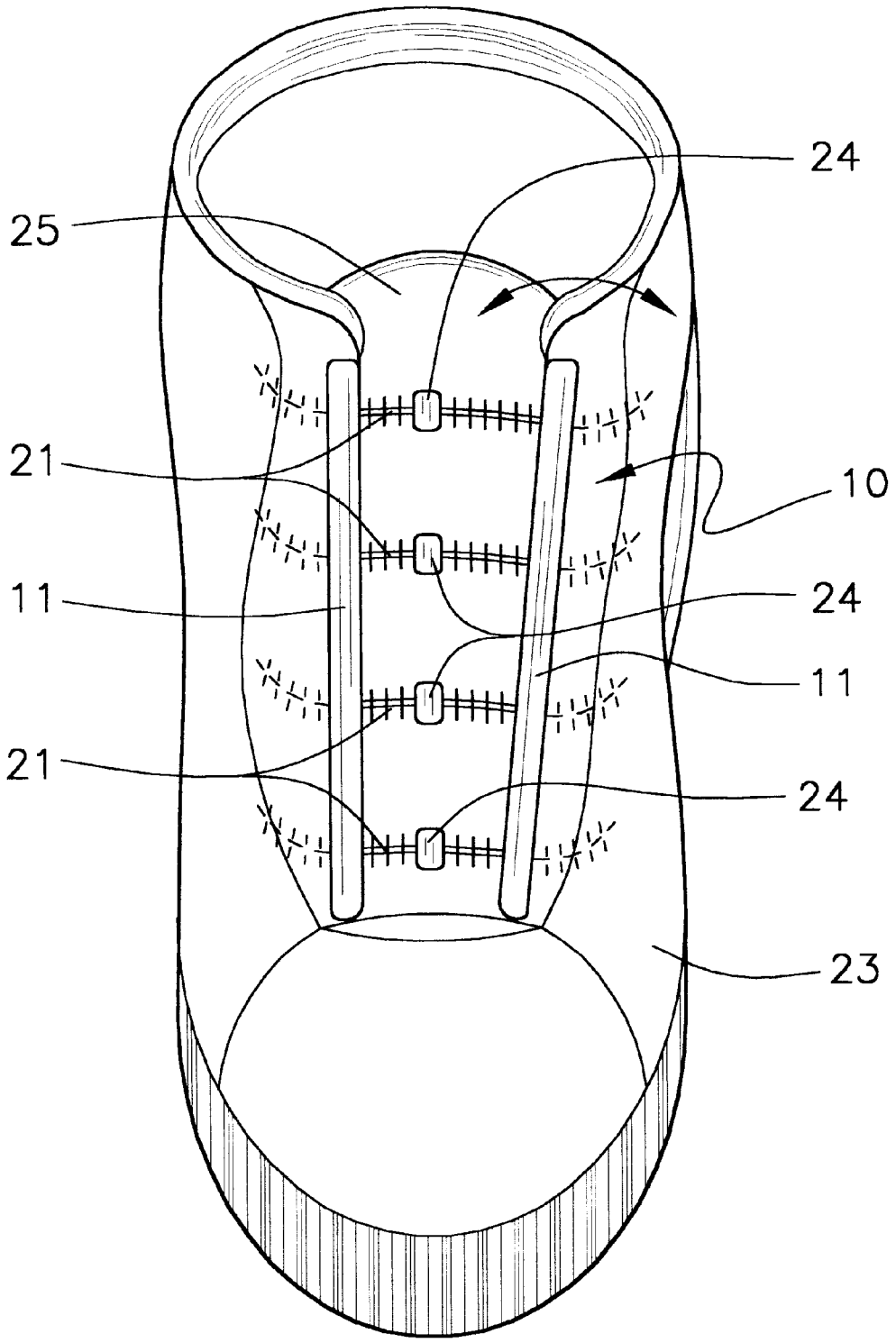
FIG. 1 is a front view of a new shoelace fastening assembly according to the present invention and shown in use.
Figure 2:
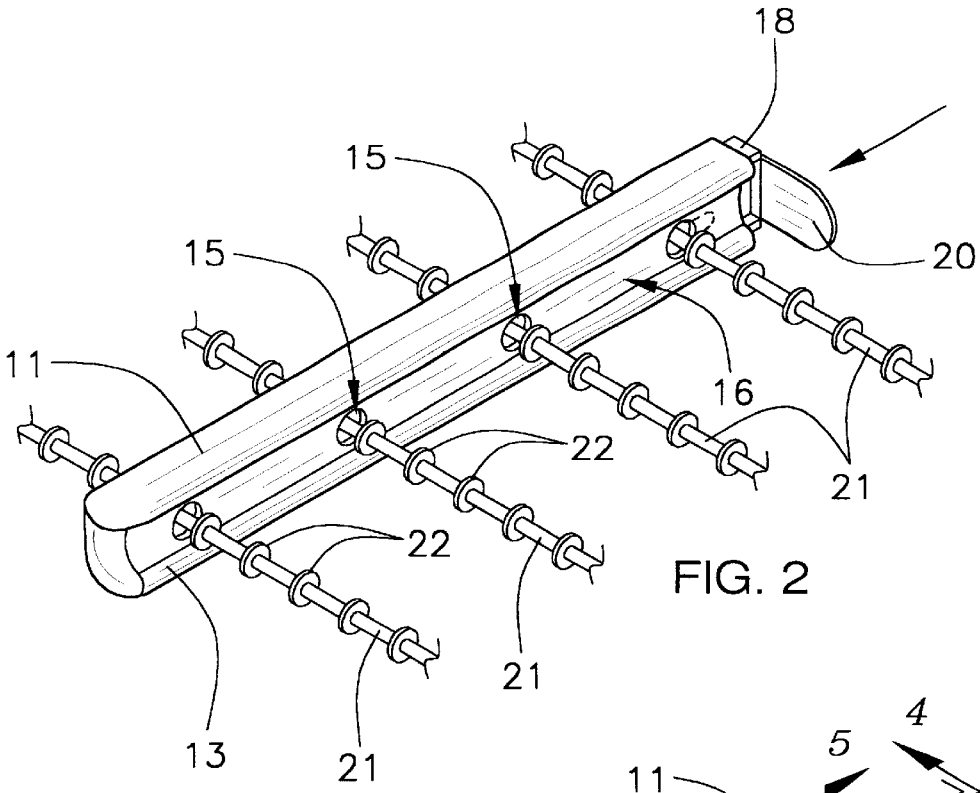
FIG. 2 is a perspective view of one of the fastener assemblies of the present invention.
Figure 3:
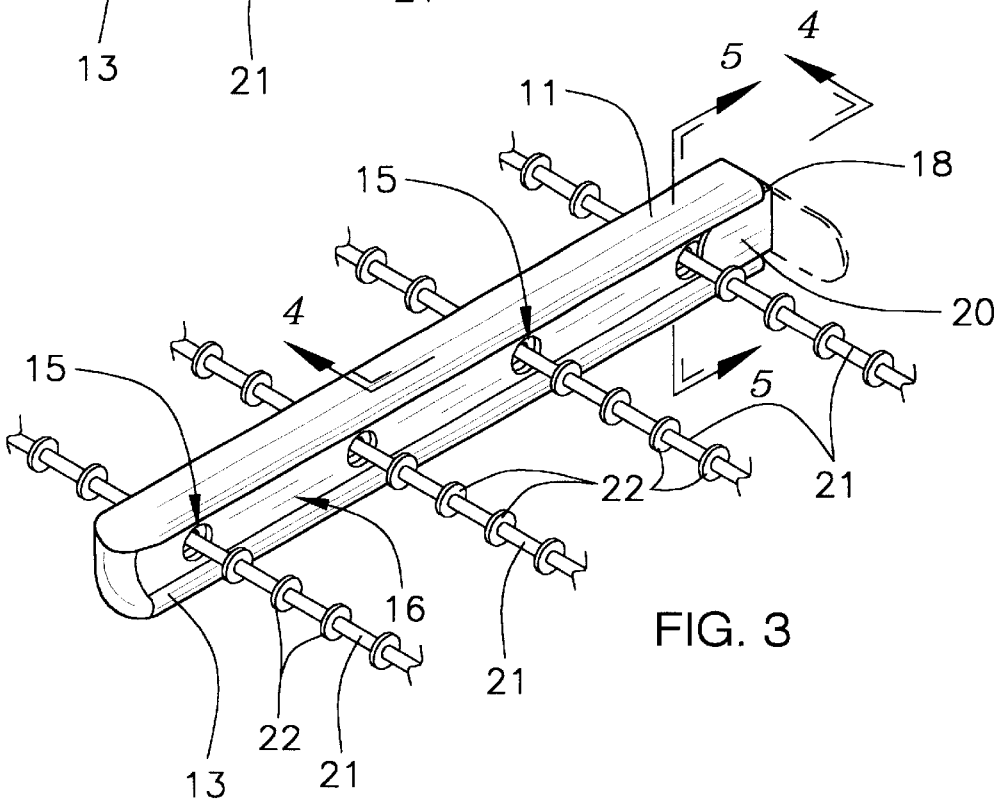
FIG. 3 is another perspective view of one of the fastener assemblies of the present invention.
Figure 4:
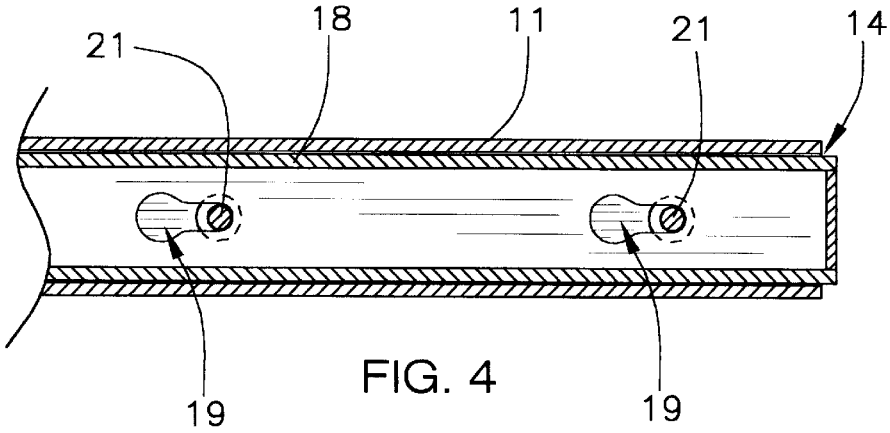
FIG. 4 is a longitudinal cross-sectional view of one of the fastener assemblies of the present invention.
Figure 5:
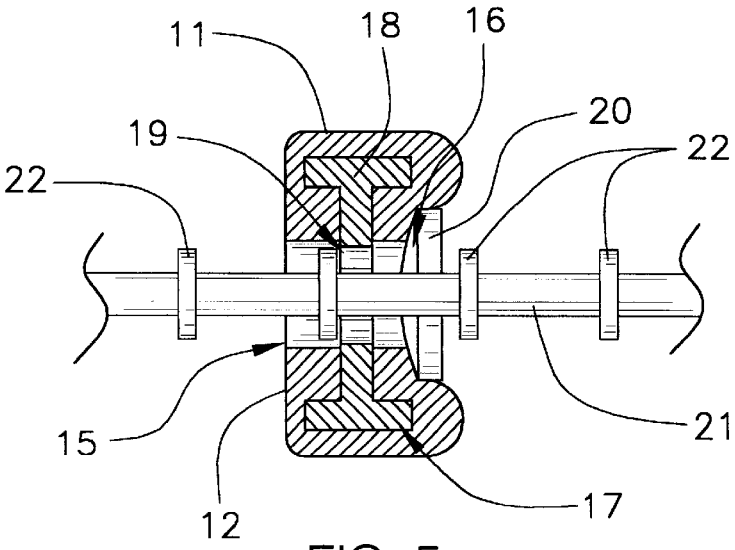
FIG. 5 is a lateral cross-sectional view of one of the fastener assemblies of the present invention.
Figure 6:
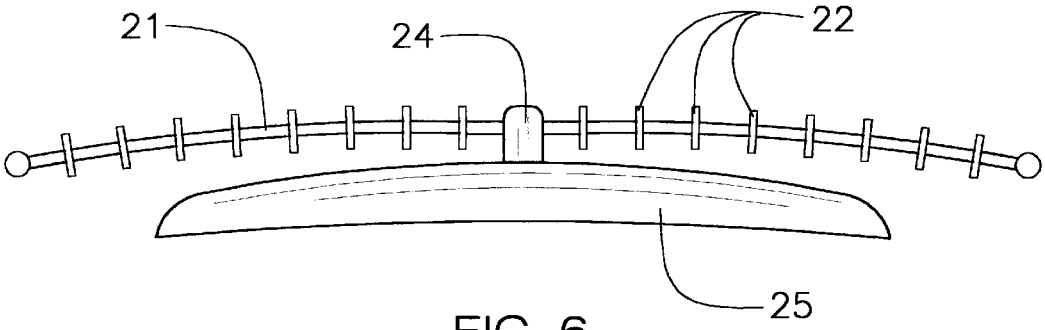
FIG. 6 is a side elevational view of one of the shoelaces of the present invention.

With reference now to the drawings, and in particular to FIGS. 1 through 6 thereof, a new shoelace fastening assembly embodying the principles and concepts of the present invention and generally designated by the reference numeral 10 will be described.

As best illustrated in FIGS. 1 through 6, the shoelace fastening assembly 10 generally comprises a pair of fastener assemblies each of which includes an elongate housing member 11 being adapted to be securely and conventionally attached along a flap edge of an instep portion of a footwear 23, and also includes a rail member 18 being slidably disposed in the elongate housing member 11. Each of the elongate housing members 11 has side walls 12,13 and an open end 14 with each of the side walls 12,13 having a plurality of holes 15 being spacedly disposed therealong and therethrough. Each of the rail members 18 is movably disposed in a respective elongate housing member 11 through the open end 14 thereof, and has a plurality of elongate openings 19 being spacedly disposed therealong and therethrough with the elongate openings 19 having end portions and an instep-like intermediate portion which is more narrow than said end portions. The pair of fastening assemblies further includes locking tab members 20 each of which is hingedly and conventionally attached at an end of a respective the rail member 18. Each of the elongate housing members 11 further includes a lateral cross-sectional I-shaped channel 17 being disposed therein. Each of the elongate housing members 11 has a groove 16 being disposed in an exterior of one of the side walls 13 and extending a length thereof with each of the locking tab members 20 being pivotally disposed in a respective groove 16 to secure the locking tab member 20 in a locked position. Each of the rail members 18 is I-shaped as viewed along a lateral cross-section and is movably disposed in a respective I-shaped channel 17.

A plurality of shoelaces 21 each having a definite length and being adjustably and fastenably disposed in and through the elongate housing members 11. Each of the shoelaces 21 is adjustably and fastenably extended through respective pairs of opposed holes 15 through the side walls 12,13 of the elongate housing members 11 and through respective elongate openings 19 through the rail members 18 with the shoelaces 21 being securely and removably wedged in one of the end portions of the elongate openings 19, and has an intermediate portion which is adapted to be securely fastened to the tongue 25 of the footwear 23 with a tongue attachment member 24.

A plurality of stop members 22 are spacedly and conventionally disposed about and along lengths of the plurality of shoelaces 21 for locking the shoelaces 21 in the elongate housing members 11. The stop members 22 are disc-shaped members being removably disposed in the elongate housing members 11 and being engagable in the teardrop-shaped openings 19 of the rail members 18.

In use, the user would slip one's foot in the footwear 23, and would slide the rail members 18 slightly from the elongate housing members 11, and then would pull on the ends of the shoelaces 21 to tighten the footwear 23 about the user's foot, and slide the rail members 18 back into the elongate housing members 11 to prevent the stop members 22 disposed in the elongate housing members 11 from moving through the holes 15 of the elongate housing members 11. The user would then pivot the locking tab members 20 into the grooves 16 to essentially lock the rail members 18. To loosen the shoelaces 21, the user would pivot the locking tab members 20 out of the grooves 16 and would slide the rail members 18 slightly out of the elongate housing members 11, and would then pull on the shoelaces 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the shoelace fastening assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoelace fastening assembly comprising:

a pair of fastener assemblies each of which includes an elongate housing member being adapted to be securely attached along an edge of an instep portion of a footwear, and also includes a rail member being slidably disposed in said elongate housing member;

a plurality of shoelaces each having a definite length and being adjustably and fastenably disposed in and through said elongate housing members; and a plurality of stop members being spacedly disposed about and along lengths of said plurality of shoelaces for locking said shoelaces in said elongate housing members.

2. A shoelace fastening assembly as described in claim 1, wherein each of said elongate housing members has side walls and an open end with each of said side walls having a plurality of holes being spacedly disposed therealong and therethrough.

3. A shoelace fastening assembly as described in claim 2, wherein each of said rail members is movably disposed in a respective said elongate housing member through said open end thereof, and has a plurality of elongate openings being spacedly disposed therealong and therethrough with each of said elongate openings having end portions and an instep-like intermediate portion which is more narrow than said end portions.

4. A shoelace fastening assembly as described in claim 3, wherein said pair of fastening assemblies further includes locking tab members each of which is hingedly attached at an end of a respective said rail member.

5. A shoelace fastening assembly as described in claim 4, wherein each of said elongate housing members further includes a lateral cross-sectional I-shaped channel disposed therein.

6. A shoelace fastening assembly as described in claim 5, wherein each of said elongate housing members has a groove being disposed in an exterior of one of said side walls and extending a length thereof, each of said locking tab members being pivotally disposed in a respective said groove to secure said locking tab member in a locked position.

7. A shoelace fastening assembly as described in claim 5, wherein each of said rail members is I-shaped as viewed along a lateral cross-section and is movably disposed in a respective said I-shaped channel.

8. A shoelace fastening assembly as described in claim 7, wherein each of said shoelaces is adjustably and fastenably extended through respective pairs of opposed said holes through said side walls of said elongate housing members and through respective said elongate openings through said rail members, and has an intermediate portion which is adapted to be securely fastened to the tongue of the footwear with a tongue attachment member, said shoelaces being securely and removably wedged in one of said end portions of said elongate openings.

9. A shoelace fastening assembly as described in claim 8, wherein said stop members are disc-shaped members being removably disposed in said elongate housing members and being engagable in said teardrop-shaped openings of said rail members.

* * * * *